US008196642B2

(12) United States Patent
Messmer et al.

(10) Patent No.: US 8,196,642 B2
(45) Date of Patent: Jun. 12, 2012

(54) PACKAGED SMALL-DUCT, HIGH-VELOCITY AIR CONDITIONER AND HEAT PUMP APPARATUS

(75) Inventors: Craig S. Messmer, St. Louis, MO (US); Henry Philip DeLima, McLean, VA (US)

(73) Assignee: Unico, Inc., St. Louis, MO (US)

( * ) Notice: Subject to any disclaimer, the term of this patent is extended or adjusted under 35 U.S.C. 154(b) by 1360 days.

(21) Appl. No.: 11/678,834

(22) Filed: Feb. 26, 2007

(65) Prior Publication Data

US 2008/0202125 A1 Aug. 28, 2008

(51) Int. Cl.
*F25B 21/00* (2006.01)

(52) U.S. Cl. ..... 165/61; 62/238.6; 62/238.7

(58) Field of Classification Search ..... 165/61, 165/240; 62/238.6, 238.7
See application file for complete search history.

(56) References Cited

U.S. PATENT DOCUMENTS 3,498,072 A * 3/1970 Stiefel ..... 62/238.6
4,569,207 A 2/1986 James
4,665,712 A 5/1987 Gehring et al.
4,792,091 A 12/1988 Martinez, Jr.
5,305,614 A 4/1994 Gilles
5,309,732 A 5/1994 Sami
5,465,588 A * 11/1995 McCahill et al. ..... 165/240
5,782,104 A 7/1998 Sami et al.
5,802,864 A * 9/1998 Yarbrough et al. ..... 62/238.6
6,253,564 B1 * 7/2001 Yarbrough et al. ..... 62/238.7
6,615,602 B2 9/2003 Wilkinson
2002/0017107 A1 2/2002 Bailey et al.
2002/0174673 A1 11/2002 Wilkinson
2004/0144118 A1 7/2004 Hebert
2004/0148950 A1 8/2004 Catzel

* cited by examiner

*Primary Examiner* — Ljiljana Ciric
(74) *Attorney, Agent, or Firm* — Thompson Coburn LLP

(57) ABSTRACT

A heating and air conditioning apparatus has an enclosure that defines an interior volume containing a compressor, a condenser coil, an expansion valve, an evaporator coil, a hot water coil, an evaporator fan, and a condenser fan. The compressor, the condenser coil, the expansion valve, and the evaporator coil are in communication with each other. The enclosure also has first and second input air openings and first and second output air openings. The evaporator fan draws air through the first input air opening and then through the evaporator coil and the hot water coil, and thereafter forces such air out of the enclosure through the first air outlet opening. The condenser fan draws air through the second input air opening and then through the condenser coil, and thereafter forces such air out of the enclosure through the second air outlet opening.

4 Claims, 6 Drawing Sheets

PACKAGED SMALL-DUCT, HIGH-VELOCITY AIR CONDITIONER AND HEAT PUMP APPARATUS

BACKGROUND OF THE INVENTION

1. Field of the Invention

The present invention pertains to a packaged small-duct, high-velocity air conditioning and heat pump apparatus that has a compact construction that facilitates its incorporation into a building structure and its connection with a small-duct, high-velocity air distribution system. The compact construction of the apparatus is achieved by a novel arrangement of a refrigerant fluid compressor, a condenser coil, an evaporator coil, expansion valves, a reversing valve, a hot water coil, a condenser fan, an evaporator fan, and control systems for the condenser and evaporator in a single enclosure that can be easily mounted in a wall of a structure to provide heating and air conditioning to the interior of the structure.

2. Description of the Related Art

Heat pumps have been used for many years as an efficient way to provide both heating and air conditioning to the interior of a structure such as a residential home, an office building, a manufacturing facility, etc. The typical heat pump is constructed with the same basic construction of an air conditioner, but with the addition of a reversing valve that allows the flow of the fluid refrigerant (typically Freon) to be reversed. In a typical air conditioner a compressor compresses cool Freon gas, increasing the pressure of the fluid and increasing the heat of the fluid. The hot, high pressure fluid is directed through a set of condenser coils typically positioned in the exterior environment of the structure. The hot, high pressure fluid passing through the condenser coils allows the fluid to cool and condense into a liquid. The condensed liquid is routed back into the interior of the structure and to an expansion valve. The liquid passes through the expansion valve which decreases the pressure of the fluid. The decreasing pressure of the fluid causes the fluid to cool and evaporate into a gas. The cold gas is routed through a set of evaporator coils and absorbs heat from the structure interior. In this manner, the air in the interior of the structure is cooled.

A heat pump is constructed in much the same manner as the air conditioner described above. The heat pump also includes a compressor, a condenser coil, an expansion valve, and an evaporator coil. In addition, the heat pump includes a reversing valve that reverses the flow of the refrigerant. When the reversing valve is switched one way, the heat pump acts as an air conditioner as described above. When the reversing valve is switched the other way, the flow of refrigerant fluid through the system coils is reversed and the system functions as a heater.

Although heat pumps are very efficient in their use of energy in both cooling and heating the interior of structures, the construction of the heat pump typically requires positioning one set of coils in the structure interior and the other set of coils in the exterior environment of the structure. Thus, the typical heat pump is basically constructed in two separate parts. The two-part construction complicates the assembly of the heat pump into a structure, requires a significant space both in the interior of the structure and at the immediately adjacent exterior environment of the structure, and complicates the assembly of the heat pump into the air conditioning and cooling system of the structure. Additionally, the use of a conventional heat pump in a structure also requires the installation of bulky duct work to convey the heating or cooling air from the heat pump.

SUMMARY OF THE INVENTION

The packaged small-duct, high-velocity air conditioner and heat pump apparatus of the invention overcomes many of the disadvantages associated with prior art heat pumps. The apparatus of the invention is provided in a single, compact enclosure that facilitates its transportation to a structure and its installation in the structure. Furthermore, the apparatus of the invention is specifically designed for use with a small-duct, high-velocity air distribution system, which further enables the apparatus of the invention to be incorporated into the construction of a structure without occupying a significant amount of the interior of the structure.

Small-duct, high-velocity (SDHV) systems are primarily used in providing heating and air conditioning to existing buildings or structures that do not have conventional air duct systems, for example in older home constructions, and in smaller structures that have smaller interiors where it is undesirable to occupy a portion of the interior with a conventional, bulky air duct system. The novel construction of small-duct, high-velocity systems reduces the disruption to the structure during installation of the system and preserves the interior and exterior appearance of the structure, in particular older homes.

The typical small-duct, high-velocity system includes a conventional outdoor condensing unit, an indoor evaporator or blower and coil unit, and an air distribution system that is comprised of smaller interior diameter or cross-sectional area ducts that handle a high-velocity of air flow through the ducts.

The packaged small-duct, high-velocity air conditioner and heat pump apparatus of the invention overcomes the disadvantage of the two-component design (i.e., the separate outdoor condensing unit and indoor evaporator unit design) of small-duct, high-velocity systems by providing a novel enclosure construction that contains all of the component parts of a small-duct, high-velocity air conditioner and heat pump in a single packaged enclosure. The enclosure is basically constructed with an interior frame that supports side walls, a bottom wall and a top wall of the enclosure. The enclosure is dimensioned to enable it to be easily transported to a construction site or an existing structure site, and positioned in a wall of the structure with one enclosure side wall directed to the structure interior and an opposite enclosure side wall directed to the exterior environment of the structure. The design of the enclosure positions air inlet and outlet openings for conditioning and heating air in the interior of the structure, and positions air inlet and outlet openings for moving heat to and from the fluid refrigerant in the exterior environment of the structure.

The interior volume of the enclosure contains all of the conventional parts of a heat pump. The enclosure is designed so that the heat pump components can be positioned in the enclosure interior in a space efficient manner. In addition to the compressor, condenser coil, expansion valve, and evaporator coil of the heat pump construction, the apparatus of the invention also includes a hot water coil that is adapted to be connected to a separate hot water source of the structure. The hot water coil provides additional heating to the structure interior.

Thus, the packaged small-duct, high-velocity air conditioner and heat pump apparatus of the invention is specifically designed to be used with small-duct, high-velocity (SDHV) duct work, and like an SDHV system, the apparatus is designed to occupy a minimum space in the interior of a structure.

Further features of the invention are set forth in the following detailed description of the preferred embodiment of the invention and in the drawing figures.

DETAILED DESCRIPTION OF THE PREFERRED EMBODIMENT OF THE INVENTION

Figure 2:
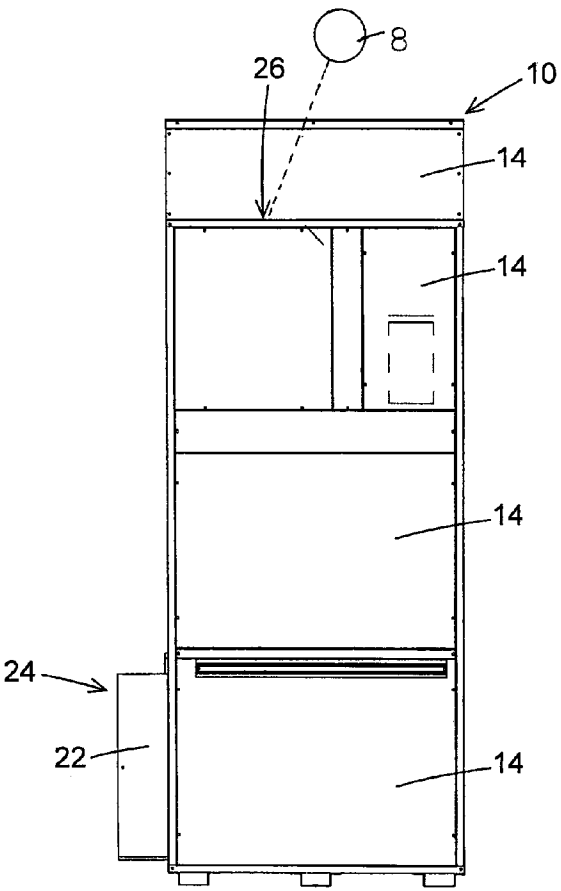
FIG. 2 is an elevation view of the enclosure side that is opposite the side shown in FIG. 1 and is positioned in the interior of the structure when the enclosure is installed in a wall of the structure.
Figure 1:
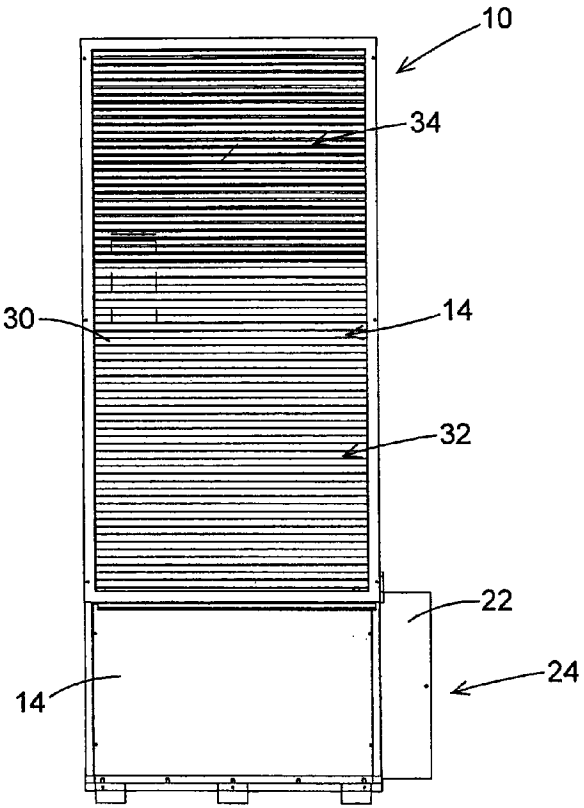
FIG. 1 is an elevation view of a side of the packaged small-duct, high-velocity air conditioner and heat pump apparatus that is positioned in the exterior environment of a structure when the apparatus is installed in a wall of the structure.

The packaged small-duct, high-velocity air conditioner and heat pump apparatus of the invention provides the basic construction of a heat pump, together with the added heating capacity of a hot water coil, in a single compact enclosure that is easily transportable and easily installed into the wall of a structure and connected with a small-duct, high-velocity air distribution system of the structure. The compact construction of the apparatus is specifically designed for use with a small-duct, high-velocity air distribution system 8, and like such an air distribution system, it is contained in a compact single enclosure that efficiently uses space to minimize the use of space in the interior of a structure in which the apparatus is installed.

The component parts of the apparatus are compactly arranged inside the single enclosure 10 shown in FIGS. 1-6. The enclosure 10 is comprised of a plurality of frame members 12 that are interconnected to form a peripheral supporting skeleton of the enclosure 10. The frame members 12 also provide support to the component parts of the apparatus to be described.

A plurality of side panels 14, bottom panels 16, and top panels 18 are secured over the frame members 12 and together enclose an interior volume 20 of the enclosure. The side panels 14 shown in FIG. 3 support a rectangular conduit 22. The conduit 22 surrounds a first air inlet opening 24 into the interior volume 20 of the enclosure. In use of the apparatus, this first air inlet opening 24 communicates with the interior of the structure in which the apparatus is installed. One of the top panels 18 shown in FIG. 6 has a first air outlet opening 26. This first air outlet opening 26 is designed to be connected to the small-duct, high-velocity air distribution system 8 of the structure in which the apparatus is used. The side wall of the enclosure shown in FIG. 1 has a large grill 30 covering over most of the side wall. The grill 30 defines two openings into the interior volume of the enclosure 10. These two openings are provided at a bottom portion of the grill 30 and a top portion of the grill 30, and respectively are a second air inlet opening 32 and a second air outlet opening 34. These openings communicate the enclosure interior volume 20 with an exterior environment of the structure in which the apparatus is used.

Figure 4:
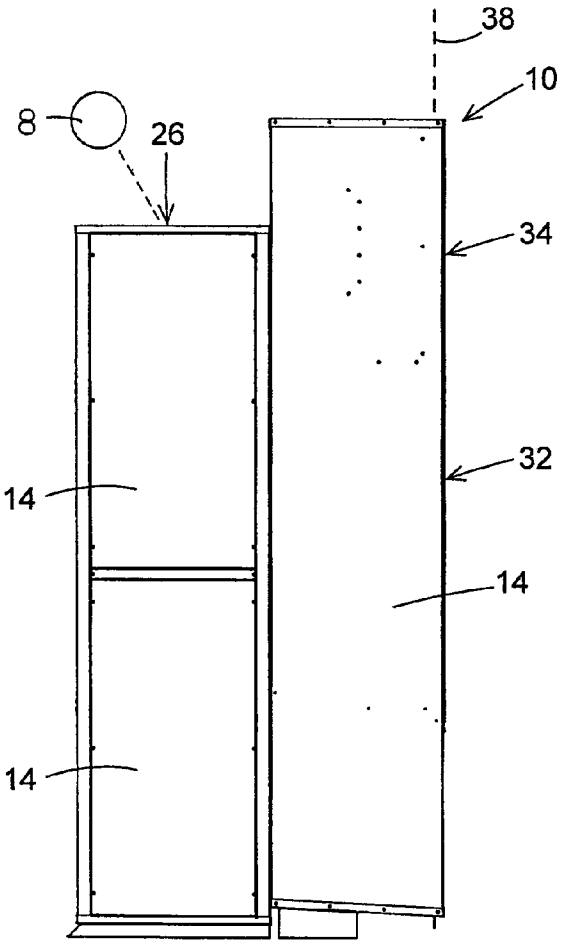
FIG. 4 is an elevation view of the left side side wall of the enclosure shown in FIG. 1.
Figure 3:
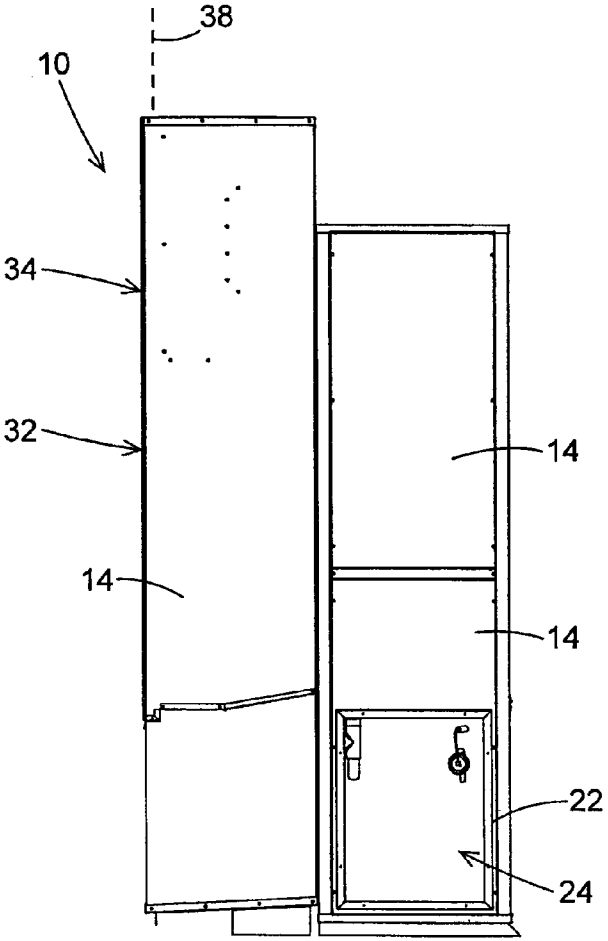
FIG. 3 is an elevation view of the right side side wall of the enclosure shown in FIG. 1.
Figure 6:
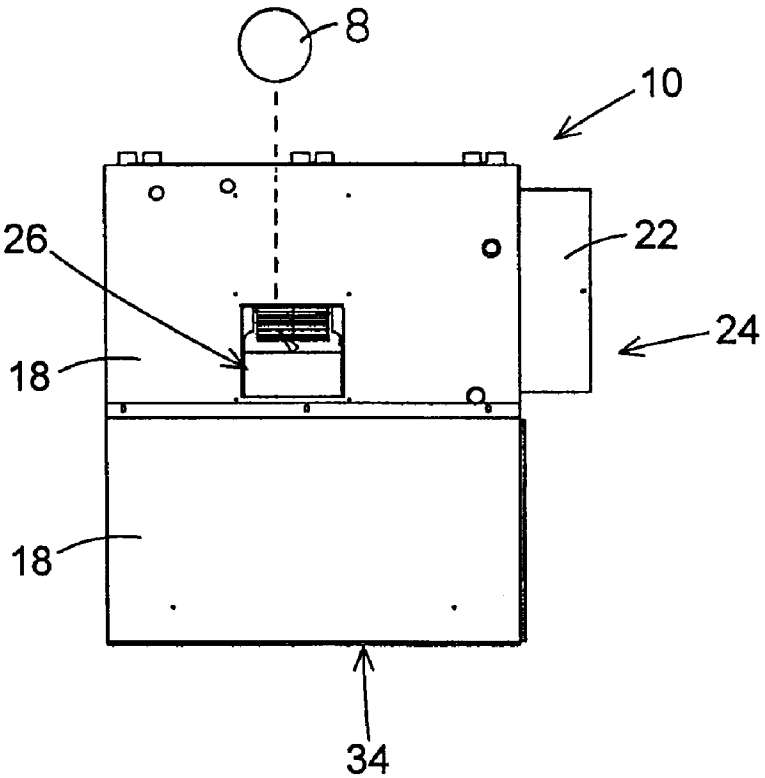
FIG. 6 is a plan view of the top of the enclosure.
Figure 5:
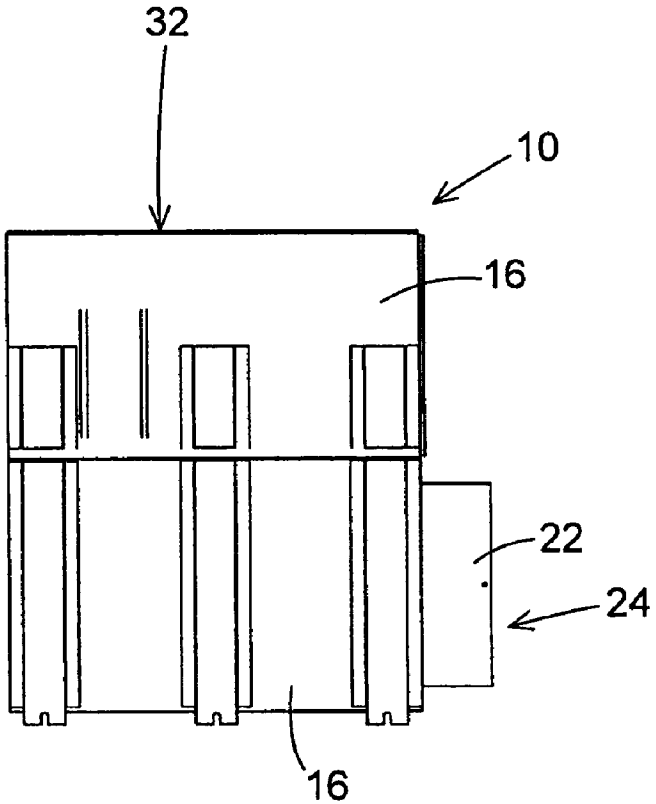
FIG. 5 is a plan view of the bottom of the enclosure.
Figure 8:
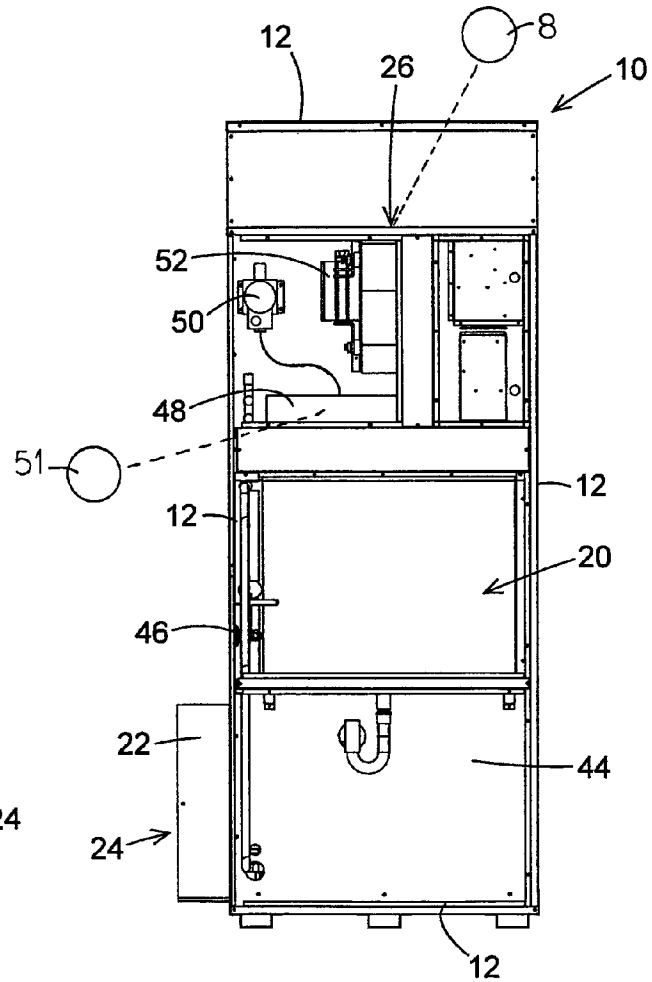
FIG. 8 is an elevation view similar to that of FIG. 2, but showing the interior of the enclosure.
Figure 7:
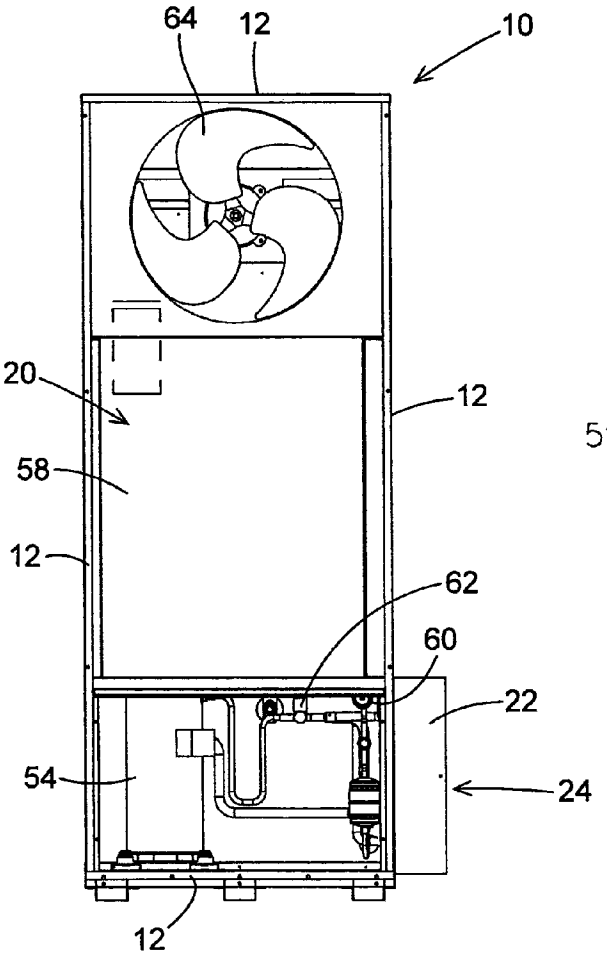
FIG. 7 is an elevation view similar to that of FIG. 1, but showing the interior of the enclosure.
Figure 10:
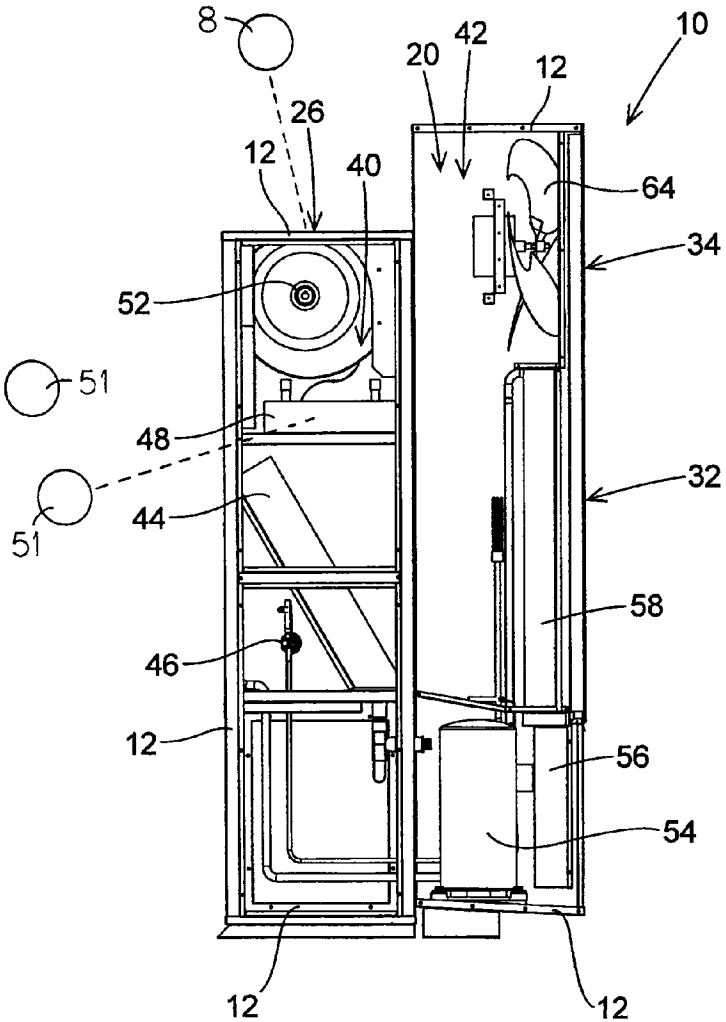
FIG. 10 is an elevation view similar to that of FIG. 4, but showing the interior of the enclosure.
Figure 9:
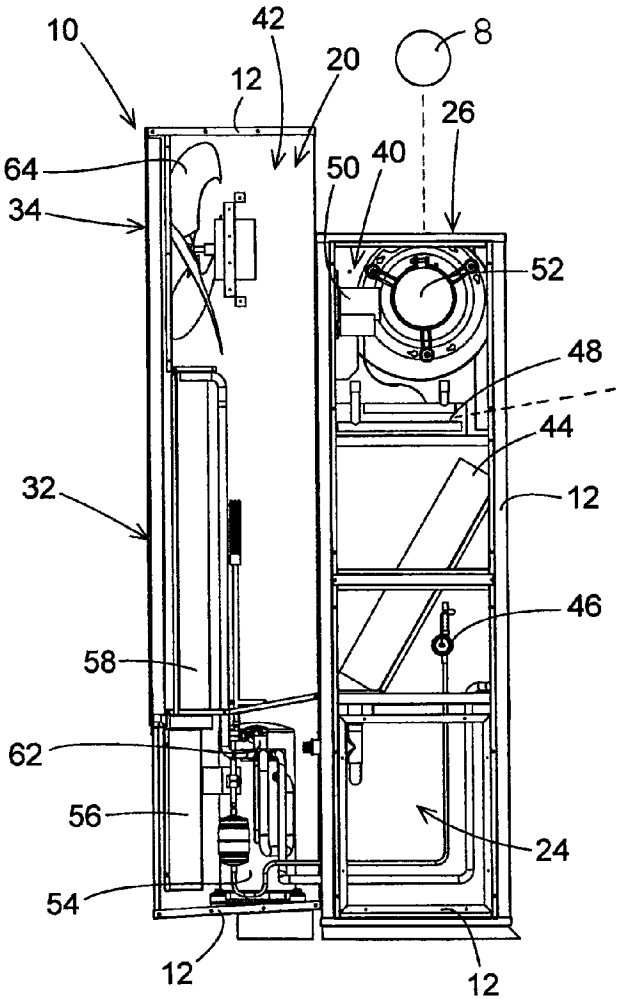
FIG. 9 is an elevation view similar to that of FIG. 3, but showing the interior of the enclosure.

The enclosure 10 is designed to be positioned in the wall of a structure where the relative position of the enclosure 10 to the wall is represented by the dashed line 38 in FIGS. 3 and 4. The construction of the enclosure 10 and the frame members 12 are also designed to divide the enclosure interior volume 20 into an evaporator side 40 that communicates with the interior of the structure and a condenser side 42 that communicates with the exterior environment of the structure.

In the evaporator side 40 of the enclosure interior volume 20, the first air inlet opening 24 in the enclosure communicates with the bottom of the interior volume 40. An evaporator coil 44 is positioned in the interior volume evaporator side 40 just above the first air inlet opening 24. The evaporator 44 is connected in fluid communication with a plurality of pipes in the conventional manner, and communicates with an evaporator expansion valve 46. The expansion valve 46 is positioned in the evaporator side 40 of the interior volume just below the evaporator coil 44.

A hot water coil 48 is positioned in the evaporator side 40 of the interior volume just above the evaporator coil 44. A hot water pump 50 is also provided in this area of the interior volume 40 and is communicated through piping with the hot water coil 48. The pump 50 is operated to circulate hot water through the coil from a separate source of hot water 51 outside of the enclosure 10. Thus, the hot water coil 48 provides an additional source of heat to the apparatus.

A blower housing containing an evaporator fan 52 is positioned just above the hot water coil 48 in the evaporator side 40 of the enclosure 10. The evaporator fan 52 is positioned directly below the first air outlet opening 26 in the enclosure top panels 18. A control box 54 containing the controls for the evaporator fan 52 is positioned adjacent the evaporator fan. Operation of the evaporator fan 52 creates a vacuum in the evaporator side 40 of the enclosure interior volume that draws air from the structure interior, through the first air inlet opening 24 into the interior volume, and directs air from the evaporator side of the interior volume 40 out through the first air outlet opening 26 to the small-duct, high-velocity air distribution system of the structure. Thus, operation of the evaporator fan 52 creates a first air flow path through the first air inlet opening 24 into the evaporator side 40 of the enclosure interior volume, through the evaporator coil 44, through the hot water coil 48, through the evaporator fan 52 and exiting the interior volume through the first air outlet opening 26 where the first air flow is delivered to the small-duct, high-velocity distribution system.

The condenser side of the interior volume 42 contains a refrigerant fluid compressor 54 positioned at the bottom of the interior volume. A control box 56 for the compressor is also positioned in this bottom portion of the interior volume. The control box 56 contains the controls for operation of the compressor 54.

A condenser coil 58 is positioned in the condenser side 42 of the interior volume just above the compressor 54. The condenser coil 58 is positioned beside a portion of the grill 30, and the position of the condenser coil 58 defines the second air inlet opening 32 through the grill 30, (i.e., the second air inlet opening 32 through the grill 30 is that portion of the grill positioned beside the condenser coil 58). A plurality of pipes communicate with the condenser coil 58 in the conventional manner, and these pipes communicate the condenser coil 58 with an expansion valve 60. The pipes also communicate the condenser coil 58 with a reversing valve 62 of the heat pump system.

A condenser fan 64 is positioned in the condenser side 42 of the enclosure interior volume just above the condenser coil 58. The condenser fan 64 is positioned adjacent an upper portion of the grill 30. The portion of the grill 30 positioned beside the condenser fan 64 defines the second air outlet opening 34 in the enclosure 10.

On operation of the condenser fan 64, a second air flow path is created through the condenser side 42 of the enclosure interior volume. The second air flow path enters the condenser side 42 of the enclosure interior volume through the second air inlet opening 32 and immediately passes through the condenser coil 58. The second air flow path then travels upwardly through the condenser side 42 of the interior volume to the condenser fan 64. The second air flow path passes through the condenser fan 64 and exits the condenser side 42 of the enclosure interior volume through the second air outlet opening 34.

Figures 11, 12:
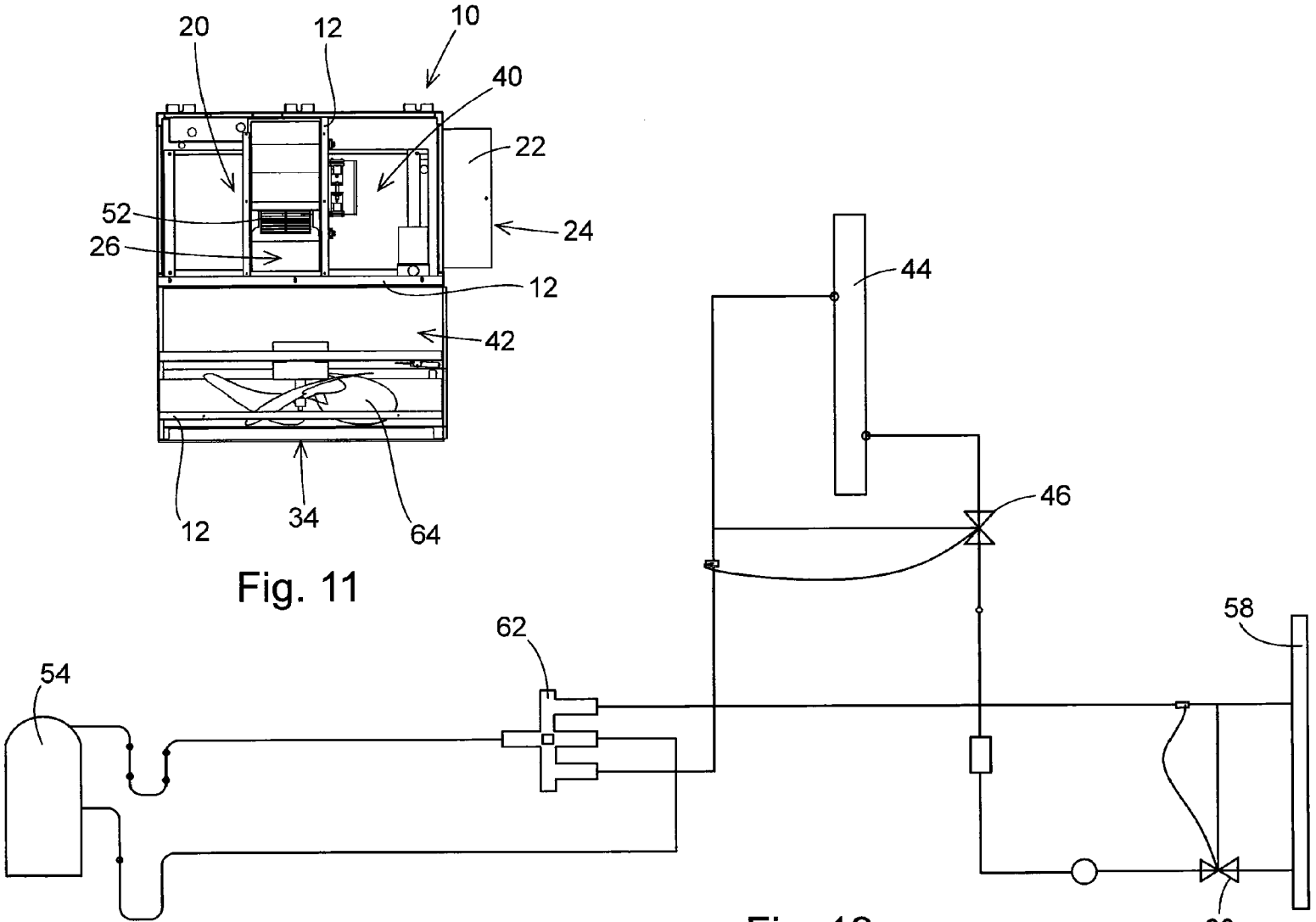
FIG. 11 is a top plan view of the enclosure similar to that of FIG. 6, but showing the interior of the enclosure.
FIG. 12 is a schematic representation of the refrigerant fluid circuit of the apparatus.

FIG. 12 is a schematic representation of the refrigerant fluid circuit through the component parts of the apparatus described above. The operation of the circuit is substantially conventional. In the cooling mode, the compressor 54 compresses the refrigerant fluid and delivers the hot, high pressure fluid to the reversing valve 62. The reversing valve 62 delivers the hot, compressed fluid to the condenser coil 58. The fluid passes through the condenser 58 and the condenser expansion valve 60 where the pressure of the fluid is decreased. The cold, low pressure fluid is then passed through the evaporator coil 44. On exiting the evaporator coil 44, the fluid is directed back to the reversing valve 62 which directs the fluid back to the compressor 52.

On operation of the circuit during the heating mode, the reversing valve 62 directs the hot, high pressure refrigerant fluid received from the compressor 52 to the evaporator coil 54. The hot, high pressure fluid passes through the evaporator coil 44 and then through the evaporator expansion valve 46. On passing through the evaporator expansion valve 46, the pressure in the fluid is reduced and the fluid is cooled. The cooled, low pressure fluid is then directed through the condenser coil 58. On exiting the condenser coil 58, the fluid is directed back through the reversing valve 62 which directs the fluid back to the compressor 52.

The packaged small-duct, high-velocity air conditioning and heat pump apparatus described above has a compact construction that facilitates its incorporation into a building structure and its connection to a small-duct, high-velocity air distribution system of the structure. The compact construction of the apparatus is achieved by the novel arrangement of the compressor, the condenser coil, the evaporator coil, the expansion valves, the reversing valve, the condenser fan, the evaporator fan, the control systems for these fans, and a hot water coil in the single enclosure. The enclosure is designed to be easily mounted in a wall of a structure to provide heading the air conditioning to the interior of the structure.

Although the apparatus of the invention has been described above by referring to a specification embodiment of the apparatus, it should be understood that modifications and variations could be made to the apparatus without departing from the scope of the following claims.

What is claimed is:

1. A heating and air conditioning apparatus small-duct, high-velocity comprising:

a single enclosure having a plurality of sidewalls, a bottom wall, and a top wall that are all interconnected to enclose an interior volume of the enclosure and to enable the enclosure to be transported as a single unit;

a refrigerant fluid compressor in the enclosure interior volume;

a condenser coil in the enclosure interior volume and in fluid communication with the compressor;

an expansion valve in the enclosure interior volume and in fluid communication with the condenser coil;

an evaporator coil in the enclosure interior volume and in fluid communication with the expansion valve and the compressor;

a hot water coil in the enclosure interior volume said hot water coil being operably connectable to a separate hot water source;

a first input air opening in the enclosure and a first output air opening in the enclosure;

an evaporator fan in the enclosure interior volume, the evaporator fan being positioned in the enclosure interior volume to draw air in a first flow path that enters the enclosure interior volume through the first input air opening and then passes through the evaporator coil, and then passes through the hot water coil, and then passes through the evaporator fan and then exits the enclosure interior volume through the first air outlet opening;

a second air input opening in the enclosure and a second air output opening in the enclosure; and, a condenser fan in the enclosure interior volume, the condenser fan being positioned in the enclosure interior volume to draw air in a second flow path that enters the enclosure interior volume through the second input air opening and then passes through the condenser coil, and then passes through the condenser fan and then exits the enclosure interior volume through the second air outlet opening.

2. The apparatus small-duct, high-velocity heating and air conditioning of claim 1, further comprising:

the enclosure being adapted to be installed in a structure wall having a first side exposed to an interior environment of the structure and an opposite second side exposed to an exterior environment of the structure with the enclosure first air input opening and first air output opening exposed to the structure interior environment and the second air input opening and second air output opening exposed to the structure exterior environment.

3. A heating and air conditioning apparatus small-duct, high-velocity comprising:

an enclosure adapted for positioning in a wall of a structure that separates an interior environment of the structure from an exterior environment of the structure, the enclosure enclosing an interior volume of the enclosure;

a refrigerant fluid compressor in the enclosure interior volume;

a condenser coil in the enclosure interior volume and in fluid communication with the compressor;

an expansion valve in the enclosure interior volume and in fluid communication with the condenser coil;

an evaporation coil in the enclosure interior volume and in fluid communication with the expansion valve and the compressor;

a reversing valve in the enclosure interior volume and in fluid communication with the compressor, the condenser coil, and the evaporator coil;

a first air inlet opening in the enclosure and a first air outlet opening in the enclosure, the first air inlet opening and the first air outlet opening being positioned on the enclosure to communicate the enclosure interior volume with the interior environment of the structure when the enclosure is positioned in the wall of the structure; and, a second air inlet opening in the enclosure and a second air outlet opening in the enclosure, the second air inlet opening being positioned on the enclosure to communicate the enclosure interior volume with the exterior environment of the structure when the enclosure is positioned in the wall of the structure and the second air outlet opening being positioned on the enclosure to communicate the enclosure interior volume with the exterior environment of the structure when the enclosure is positioned in the wall of the structure.

4. The apparatus small-duct, high-velocity heating and air conditioning of claim 3, further comprising:

the condenser coil being positioned in the enclosure interior volume beside the second air inlet opening; and the condenser fan being positioned in the enclosure interior volume above the condenser coil and beside the second air outlet opening.

* * * * *